US006244682B1

(12) United States Patent
Walker et al.

(10) Patent No.: US 6,244,682 B1
(45) Date of Patent: Jun. 12, 2001

(54) METHOD AND APPARATUS FOR ESTABLISHING INK-JET PRINTHEAD OPERATING ENERGY FROM AN OPTICAL DETERMINATION OF TURN-ON ENERGY

(75) Inventors: Steven H Walker, Camas; Kerry Lundsten, Vancouver, both of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/237,130

(22) Filed: Jan. 25, 1999

(51) Int. Cl.[7] ..... B41J 2/01
(52) U.S. Cl. ..... 347/19
(58) Field of Search ..... 347/14, 19; 353/504, 353/406

(56) References Cited

U.S. PATENT DOCUMENTS

| | | | |
|---|---|---|---|
| 4,910,528 | 3/1990 | Firl et al. | 346/1.1 |
| 5,418,558 | 5/1995 | Hock et al. | 347/14 |
| 5,428,376 | 6/1995 | Wade et al. | 347/14 |
| 5,526,027 | 6/1996 | Wade et al. | 347/14 |
| 5,682,185 | 10/1997 | Wade et al. | 347/19 |
| 5,751,302 | 5/1998 | Rezanka | 347/9 |
| 6,027,201 * | 2/2000 | Edge | 347/19 |

FOREIGN PATENT DOCUMENTS

| | | |
|---|---|---|
| 0650838 | 5/1995 | (EP) . |
| WO 98/46430 | 10/1998 | (WO) . |

OTHER PUBLICATIONS

European Patent Office, European Search Report, Nov. 15, 2000.

* cited by examiner

*Primary Examiner*—John Barlow
*Assistant Examiner*—Craig A. Hallacher

(57) ABSTRACT

A method and apparatus for optical determination of turn-on energy and operational printhead energy for ink-jet printing includes a computerized method for using reflectance readings from a test pattern generated by a printhead under test. The test pattern includes regions (|1|–|N|) generated by applying to the printhead ink drop generators firing pulses having a pulse energy substantially equal to a predetermined reference pulse energy at a predetermined pulse frequency starting with a pulse energy substantially equal to the predetermined reference energy and incrementally changing the pulse energy of the firing pulses such that firing pulses of increasing or decreasing pulse energies are sequentially applied to the drop generators. Using the reflectance data, determining a printhead operational firing energy pulse value that is a predetermined percentage of a turn-on energy defined as a value greater than an energy pulse value where said heaters cease to fire ink, wherein said printhead operational firing energy pulse value is provided to a printhead controller for printing operations subsequent thereto. The process can be automatically implemented in order to perform subsequent printing operation with a printhead operating energy that provides a desired print quality while avoiding premature failure of printhead heater resistors.

27 Claims, 7 Drawing Sheets

METHOD AND APPARATUS FOR ESTABLISHING INK-JET PRINTHEAD OPERATING ENERGY FROM AN OPTICAL DETERMINATION OF TURN-ON ENERGY

BACKGROUND OF THE INVENTION

1. Field of the Invention

The present invention relates generally to ink-jet printing and, more specifically to a method and apparatus for automated optical determination of optimized energy requirements for firing ink droplets from an ink-jet printhead, producing high quality printing while preserving printhead life.

2. Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in *Output Hardcopy* [*sic*] *Devices*, chapter 13 (Ed. R. C. Durbeck and S. Sherr, Academic Press, San Diego, 1988).

FIG. 1 depicts an ink-jet hard copy apparatus, in this exemplary embodiment, a computer peripheral, color printer, 101. A housing 103 encloses the electrical and mechanical operating mechanisms of the printer 101. Operation is administrated by an electronic controller (usually a microprocessor or application specific integrated circuit ("ASIC") controlled printed circuit board, not shown, but see FIGS. 1A and 3) connected by appropriate cabling to a computer (not shown). It is well known to program and execute imaging, printing, print media handling, control functions, and logic with firmware or software instructions for conventional or general purpose microprocessors or ASIC's. Cut-sheet print media 105, loaded by the end-user onto an input tray 107, is fed by a suitable paper-path transport mechanism (not shown) to an internal printing station where graphical images or alphanumeric text are created using state of the art color imaging and text rendering techniques. A carriage 109, mounted on a slider 111, scans the print medium. An encoder strip and its appurtenant devices 113 are provided for keeping track of the position of the carriage 109 at any given time. A set 115 of individual ink-jet pens, or print cartridges 117A–117D are releasably mounted in the carriage 109 for easy access and replacement; generally, in a full color system, inks for the subtractive primary colors, cyan, yellow, magenta (CYM) and true black (K) are provided. Each pen or cartridge has one or more printhead mechanisms (not seen in this perspective) for "jetting" minute droplets of ink to form dots on adjacently positioned print media. Once a printed page is completed, the print medium is ejected onto an output tray 119.

In essence, the ink-jet printing process involves dot-matrix manipulation of droplets of ink ejected from a pen onto an adjacent print medium (for convenience of explanation, the word "paper" is used hereinafter as generic for all forms of print media). An ink-jet pen $\mathbf{117}_x$ includes a printhead which consists of a number of columns of ink nozzles. Each column (typically less than one-inch in total height) of nozzles selectively fires ink droplets (typically only several picoliters in liquid volume) from addressed nozzles that are directed to create a predetermined print matrix of dots on the adjacently positioned paper as the pen is scanned across the media. A given nozzle of the printhead is used to address a given vertical print column position, referred to as a picture element, or "pixel," on the paper. Horizontal positions on the paper are addressed by repeatedly firing a given nozzle as the pen is scanned across its width. Thus, a single sweep scan of the pen can print a swath of dots. The paper is stepped to permit a series of contiguous swaths. Dot matrix manipulation is used to form alphanumeric characters, graphical images, and even photographic reproductions from the ink drops. Generally, the pen scanning axis is referred to as the x-axis, the paper transport axis is referred to as the y-axis, and the ink drop firing direction is referred to as the z-axis.

Within a thermal ink-jet printhead—in the state of the art having such small dimensions that thin film, integrated circuit fabrication techniques are employed in manufacture—a set of ink drop generators includes individually activated ink heater resistors subjacent the ink firing nozzles. An attribute of printing is the minimum energy required for a given printhead to eject an ink drop, also known as turn-on energy, "TOE." Due to design manufacturing tolerance variations, TOE can vary significantly for a particular pen design specification. Therefore, a printer must provide ink drop firing pulses to fire a compatible pen having the highest TOE. Use of a pen with a lower TOE requires that pen to dissipate the difference in the energy required and the energy delivered—viz., highest specified TOE—in the form of heat. The greater the variation in TOE, the greater the excessive energy, i.e., heat buildup. The amount of excess heat that a given pen can tolerate is a function of the operating temperature range and the acceptable reliability for the particular application. The relationship of TOE to the ability to dissipate heat is known as a particular pen design "energy budget." Moreover, as drop generator density increases on the printhead—e.g., from 150 nozzles to 300 nozzles in substantially the same size circuit—the ability to dissipate heat decreases. While most of the energy is carried away by the ejected ink drop, the increase in drop generator density decreases the overall energy budget.

The goal therefore is to control electrical firing pulses such that the printhead is operated at a pulse energy that is approximately at or greater than the turn-on energy of the resistor and within a range that provides the desired print quality while avoiding premature failure of the heater resistors due to variation in TOE becoming great relative to a pen's ability to dissipate heat.

There is a need to measure actual TOE for a given pen-printer combination to calculate an operating energy given an energy budget and to set dynamically a TOE-related operating energy to optimize printing operations. The variation in TOE and printers is thereby adjusted out, increasing the margin for reliability and operating temperature range, and increasing the energy budget.

In the prior art TOE determination is known to be done with thermal sensing, a process referred to as "TTOE." Referring now to FIG. 1A (PRIOR ART), shown is a simplified block diagram of a thermal ink-jet hard copy engine. A controller 11 receives print data 10 input and processes the print data to provide print control information to a printhead driver circuit 13. A controlled voltage power supply 15 provides to the printhead driver circuit 13 a controlled supply voltage, Vs, whose magnitude is controlled by the controller 11. The printhead driver circuit 13, as controlled by the controller 11, applies driving or energizing voltage pulses of voltage, VP, to a thin film integrated circuit thermal ink jet printhead 19 that includes thin film ink drop firing heater resistors 17. The voltage pulses VP are typically applied to contact pads that are connected by conductive traces to the heater resistors 17, and therefore the pulse voltage received by a resistor is typically less than the pulse voltage VP at the printhead contact pads. Since the actual voltage across a heater resistor 17 cannot be readily measured, thermal turn-on energy for a heater resistor as described herein will be with reference to the voltage applied to the contact pads of the printhead cartridge associated with the heater resistor. The resistance associated with a heater resistor 17 will be expressed in terms of pad-to-pad resistance of a heater resistor and its interconnect circuitry (i.e., the resistance between the printhead contact pads associated with a heater resistor). The relation between the pulse voltage VP and the supply voltage Vs will depend on the characteristics of the driver circuitry. For example, the printhead driver circuit 13 can be modeled as a substantially constant voltage drop, VD, and for such implementation the pulse voltage VP is substantially equal to the supply voltage Vs reduced by the voltage drop VD of the driver circuit:

$$VP=Vs-VD \quad \text{(Equation 1).}$$

If the printhead driver 13 is better modeled as having a resistance, Rd, then the pulse voltage is expressed as:

$$VP=Vs(Rp/(Rd+Rp)) \quad \text{(Equation 2),}$$

where Rp is the pad-to-pad resistance associated with a heater resistor 17.

More particularly, the controller 11 provides pulse width and pulse frequency parameters to the printhead driver circuitry 13 which produces drive voltage pulses of the width and frequency as selected by the controller, and with a voltage VP that depends on the supply voltage Vs provided by the voltage controlled power supply 15 as controlled by the controller 11. Essentially, the controller 11 controls the pulse width, frequency, and voltage of the voltage pulses applied by the driver circuit to the heater resistors.

The integrated circuit printhead 19 of the thermal ink jet printer of FIG. 1A (PRIOR ART) further includes a sample resistor 21 having a precisely defined resistance ratio relative to each of the heater resistors 17, which is readily achieved with conventional integrated circuit thin film techniques. By way of illustrative example, the resistance sample resistor 21 and its interconnect circuit are configured to have a pad-to-pad resistance that is the sum of: (a) 10 times the resistance of each of the heater resistors and (b) the resistance of an interconnect circuit for a heater resistor. One terminal of the sample resistor is connected to ground while its other terminal is connected to one terminal of a precision reference resistor Rp that is external to the printhead and has its other terminal connected to a voltage reference, Vc. The junction between the sample resistor 21 and the precision resistor Rp is connected to an analog-to-digital converter (A/D) 24. The digital output of the A/D converter 24 comprises quantized samples of the voltage at the junction between the sample resistor 21 and the precision resistor Rp. Since the value of the precision resistor Rp is known, the voltage at the junction between the sample resistor 21 and the precision resistor Rp is indicative of the pad-to-pad resistance of the sample resistor 21 which in turn is indicative of the resistance of the heater resistors.

The controller 11 determines a thermal turn-on pulse energy for the printhead 19 that is empirically related to a steady state drop volume turn-on energy which is the minimum steady state pulse energy at which a heater resistor 17 produces an ink drop of the proper volume, wherein pulse energy refers to the amount of energy provided by a voltage pulse; i.e., power multiplied by pulse width. In other words, increasing pulse energy beyond the drop volume turn-on energy does not substantially increase drop volume. FIG. 2 (PRIOR ART) sets forth a representative graph of normalized printhead temperature and normalized ink drop volume plotted against steady state pulse energy applied to each of the heater resistors of a thermal ink jet printhead. Discrete printhead temperatures are depicted by crosses (+) while drop volumes are depicted by hollow squares (□). The graph of FIG. 2 (PRIOR ART) indicates three different phases of operation of the heater resistors of a printhead. The first phase is a non-nucleating phase wherein the energy is insufficient to cause nucleation. In the non-nucleating phase printhead temperature increases with increasing pulse energy while ink drop volume remains at zero. The next phase is the transition phase wherein the pulse energy is sufficient to cause ink drop forming nucleation for some but not all heater resistors, but the ink drops that are formed are not of the proper volume. In the transition phase the ink drop volume increases with increasing pulse energy, since more heater resistors are firing ink drops and the volume of the ink drops formed are approaching the appropriate drop volume, while the printhead temperature decreases with increasing pulse energy. The decrease in printhead temperature is due to transfer of heat from the printhead by the ink drops. The next phase is the mature phase wherein drop volume is relatively stable and temperature increases with increasing pulse energy. FIG. 2 (PRIOR ART) shows only the lower energy portion of the mature phase, and it should be appreciated that printhead temperature increases with increased pulse energy since ink drop volume remains relatively constant in the mature phase.

As discussed more fully in U.S. Pat. No. 5,428,376, Wade et al., assigned to the common assignee of the present invention, the sample resistor 21 can be utilized to determine the pad-to-pad resistance associated with the heater resistors in order to determine the energy provided to the heater resistors as a function of the voltage VP and pulse width of the voltage pulses provided by the driver circuit. The integrated circuit printhead of the thermal ink jet printer of FIG. 1A (PRIOR ART) also includes a temperature sensor 23 located in the proximity of some of the heater resistors, and provides an analog electrical signal representative of the temperature of the integrated circuit printhead. The analog output of the temperature sensor 23 is provided to an analog-to-digital converter 25 which provides a digital output to the controller 11. The digital output of the A/D converter 25 comprises quantized samples of the analog output of the temperature sensor 321. The output of the A/D converter is indicative of the temperature detected by the temperature sensor. The output of the temperature sensor is sampled for the different ink firing pulse energies applied to the heater resistors, for example at least one sample at each different ink firing pulse energy. For a properly operating printhead and temperature sensor, temperature data acquisition by stepwise pulse energy decrementing and temperature sampling continues until it is determined that acceptable temperature data has been produced. TTOE for a target drop volume is calculated accordingly.

Another prior art method of measuring TOE for the ejection of ink drops is known as visual turn-on energy, "VTOE," process. A pattern comprising lines printed by each of the pen's nozzles of one or all colors is printed at a known energy setting. The energy is decremented a known amount and a nozzle pattern is printed adjacent to the previous pattern. Continuing in this fashion, eventually the energy level is reached in which a substantial number of the nozzles (usually greater than ten percent) are no longer being printing. The TOE level corresponding to the last area that did print as a complete patten is selected by the observer, either during final manufacturing test phase or by the end-user.

Yet another prior art method is the use of electrostatic discharge as a method of TOE measurement. A charged plate is mounted in a printer service station such that as ink drops hit the plate a charge transfer can occur, generating a current. By firing ink drops at increasing energy levels, the onset of a current flow determines the TOE.

There is a need for a method for determining turn-on energy that is independent of both printhead thermal response and subjective observer analysis and intervention. There is a need for a method and apparatus that calibrates turn-on energy relative to actual print data. Moreover, there is a need for an automatic calibration of printhead turn-on energy and an appropriately related printhead operation energy that can be instigated without end user intervention.

SUMMARY OF THE INVENTION

In its basic aspects, the present invention provides a method of determining ink-jet printhead operating energy, including the steps of: printing a test pattern having predetermined objects wherein a series of the objects is printed sequentially using different printhead firing energies having a predetermined pulse energy range; optically scanning the series of the objects with a scanning apparatus; using the scanning apparatus, recording a first data set representative of reflectance for each of the objects; from the first data set, determining a first firing energy value indicative of onset of nozzles ceasing to fire ink; and determining the ink-jet printhead operating energy as a predetermined percentage of the first firing energy value.

The present invention also provides a method for operating a thermal ink-jet printer having a printhead having ink drop generators responsive to electrical pulses provided to the printhead, the pulses having a voltage, a pulse width, and a pulse energy defined by voltage, pulse width, and resistance at the printhead and controlled by a drop generator firing algorithm, including the steps of: printing a test pattern in a predetermined axis by applying to the ink drop generators firing pulses having a pulse energy substantially equal to a predetermined reference pulse energy at a predetermined pulse frequency starting with a pulse energy substantially equal to the predetermined reference energy and incrementally changing the pulse energy of the firing pulses such that firing pulses of increasing or decreasing pulse energies are sequentially applied to the drop generators; scanning the test pattern with a sensing mechanism for determining spatial changes in reflectance of the pattern relative to positions within the pattern where incrementally changing pulse energy occurred and sampling a predetermined number of reflectance data points within the pattern between changes of pulse energy; determining a predetermined number of reflectance values for the pattern in the predetermined axis as an average reflectance value for the predetermined number of reflectance data points approximately equal to the number of changes of pulse energy; fitting a curve to the predetermined number of reflectance data points; determining from the curve a first value indicating a pulse energy maximum indicative of all nozzle firing ink and a second value indicating a pulse energy minimum indicative of no nozzles firing ink; calculating from the first value and the second value a turn-on energy threshold value; determining from the turn-on energy threshold value and the curve a turn-on energy value; determining a final printhead operating energy value which is a predetermined percentage of the turn-on energy value; and providing the drop firing algorithm with the final printhead operating energy value.

Another basic aspect of the invention provides a self-calibrating printhead operating energy ink-jet hard copy apparatus including: an ink-jet printhead including a plurality of ink firing heaters associated with ink-jet printhead nozzles; controlled voltage mechanisms for providing an energy pulse to the heaters; connected to the controlled voltage mechanisms, controller mechanisms for providing a first data set for printing a test pattern with the printhead in a predetermined axis by applying to the heaters energy pulses having a pulse energy substantially equal to a predetermined reference pulse energy at a predetermined pulse frequency starting with a pulse energy substantially equal to the predetermined reference energy and incrementally changing the pulse energy of the firing pulses such that firing pulses of increasing or decreasing pulse energies are sequentially applied to the heaters; optical scanning mechanisms for acquiring data indicative of reflectance values across the pattern; mechanisms for determining from the data a printhead operating energy pulse value that is a predetermined percentage of a turn-on energy threshold defined as a value greater than an energy pulse value where the heaters no longer fire all nozzles, wherein the operating energy pulse value is provided to the controller mechanisms for printing operations subsequent thereto.

In another basic aspect, the present invention provides a computer memory for determining operating energy for an ink-jet printhead, the invention including: mechanisms for printing a test pattern having predetermined objects wherein a series of the objects is printed using different printhead firing energy ranging from a maximum firing energy value to a minimum firing energy value; mechanisms for receiving data acquired by optically scanning the series of the objects and recording a first data set having a value representative of reflectance for each of the objects; mechanisms for determining from the first data set a first firing energy value indicative of onset of non-firing of ink-jet nozzles of ink; and mechanisms for determining the ink-jet printhead operating energy as a predetermined percentage of the first firing energy value.

It is an advantage of the present invention that it provides an objective TOE measurement construct by directly sensing the presence of ejected ink drops.

It is an advantage of the present invention that it provides an objective test and thus repeatable results.

It is an advantage of the present invention that it provides objective print quality selection that is more accurate compared to subjective visual judgment tests.

It is an advantage of the present invention that it measures TOE in the printer use environment, adjusting for all sources of variance.

It is another advantage of the present invention that it can be performed multiple times of the life of a pen, compensating for aging effects.

It is another advantage of the present invention that in multiple pen printers, TOE of each pen can be determined, identifying the greatest TOE of a particular set of pens.

It is another advantage of the present invention that it improves energy budget attributes and associated reliability goals.

It is a further advantage of the present invention that it provides a methodology applicable to all pen architectures and printing platforms.

It is a further advantage of the present invention that it provides for a relative measurement, not requiring calibration.

It is a further advantage of the present invention that it is independent of media type.

It is still another advantage of the present invention that it can be implemented as an automatic operational adjustment.

It is yet another advantage of the present invention that an optical sensor can be used multifunctionally, providing a cost effective product.

Other objects, features and advantages of the present invention will become apparent upon consideration of the following explanation and the accompanying drawings, in which like reference designations represent like features throughout the drawings.

BRIEF DESCRIPTION OF THE DRAWINGS

FIGS. 4-1 and 4-2 provides a flow chart outlining the process for optically determining optimal printhead turn-on energy in accordance with the present invention.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable.

Figure 1:
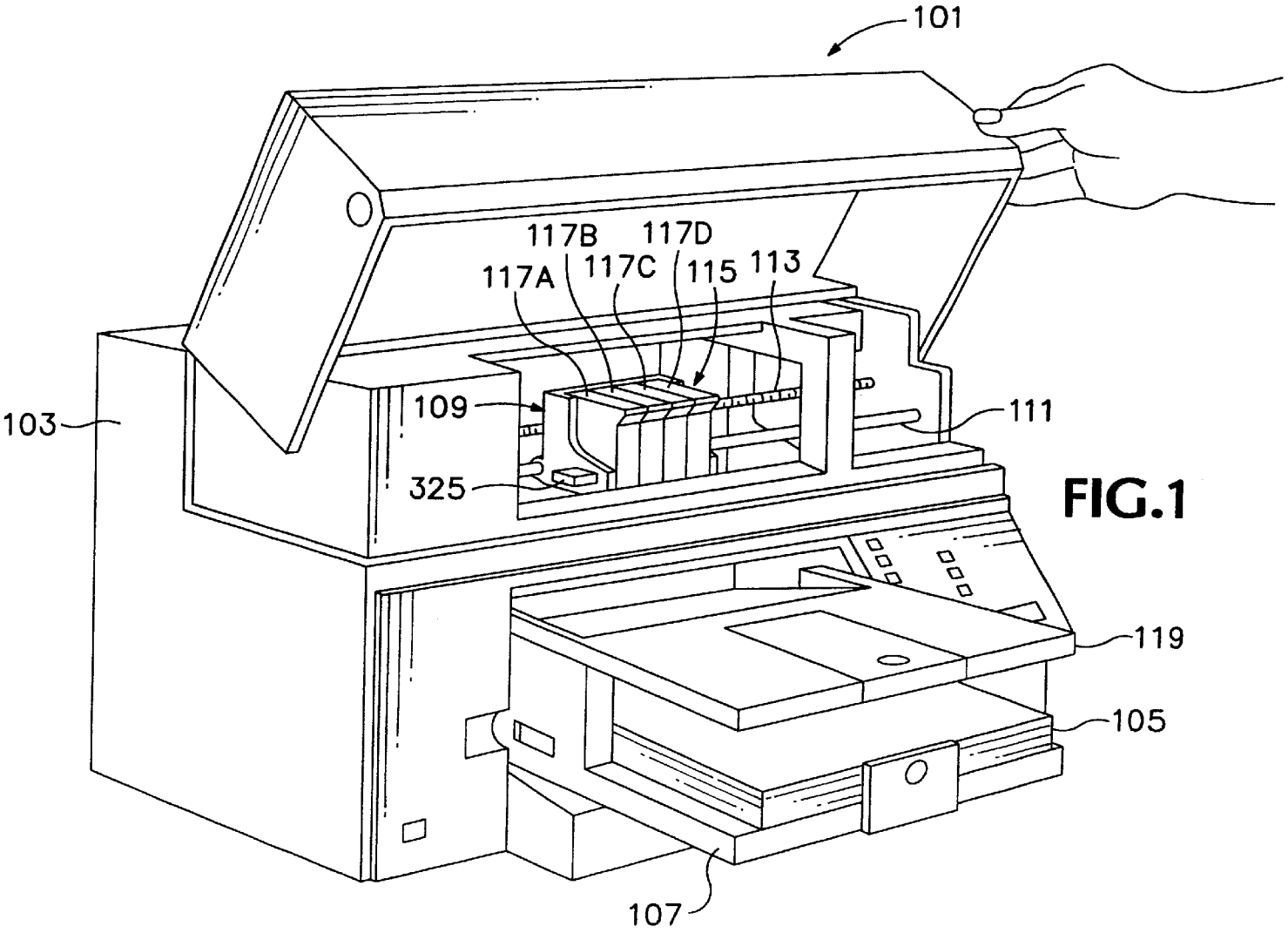
FIG. 1 is an exemplary embodiment ink-jet printer in accordance with the present invention.
Figure 1A:
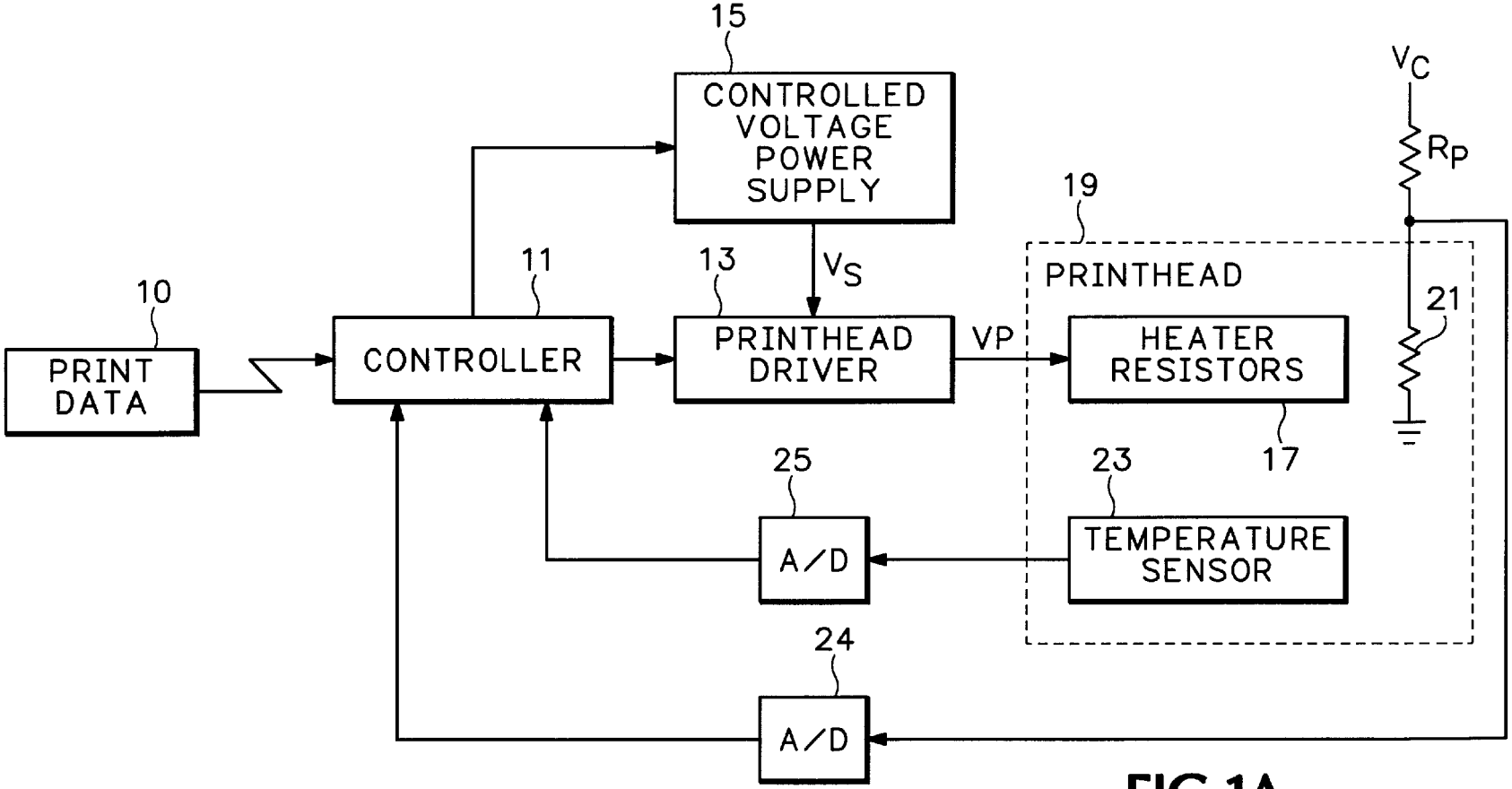
FIG.1A (PRIOR ART)
FIG. 1A (PRIOR ART) is a schematic block diagram of the thermal ink-jet components for a TTOE printing system.
Figure 3:
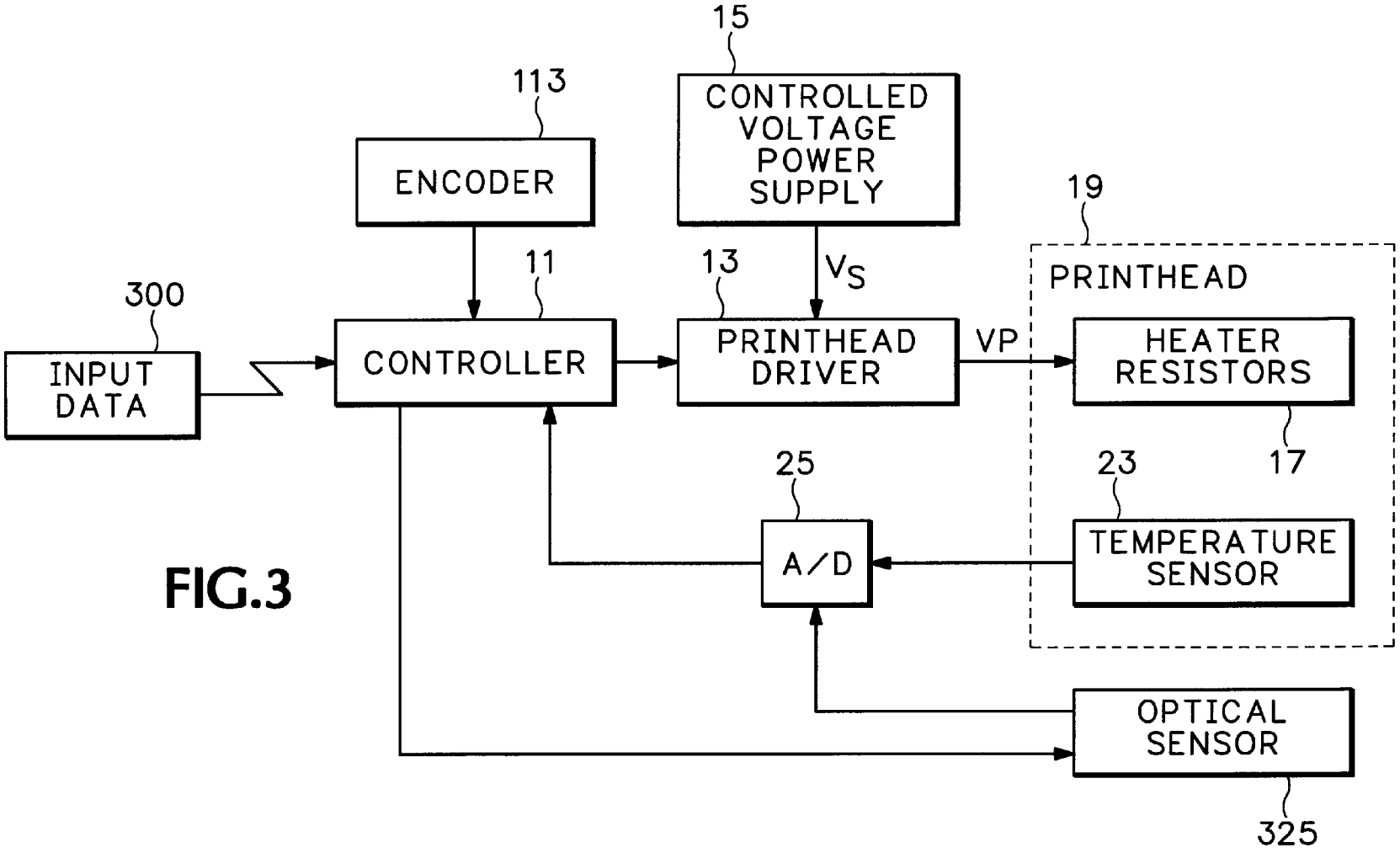
FIG. 3 is a schematic block diagram of thermal ink-jet components of an optical turn-on energy system in accordance with the present invention.

As shown in FIG. 3, and referring also to FIG. 1, using a known manner printer 101 as an exemplary embodiment, a controller 11 receives print data 300 input and processes the print data to provide print control information to a printhead driver circuit 13. A controlled voltage power supply 15 provides to the printhead driver circuit 13 a controlled supply voltage, Vs, whose magnitude is controlled by the controllers 11. The printhead driver circuit 13, as controlled by the controller 11, applies driving or energizing voltage pulses of voltage VP to a thin film integrated circuit thermal ink jet printhead 19 that includes thin film ink drop firing heater resistors 17. The integrated circuit printhead of the thermal ink jet printer of FIG. 3 also includes a temperature sensor 23 located in the proximity of some of the heater resistors, and provides an analog electrical signal representative of the temperature of the integrated circuit printhead. The analog output of the temperature sensor 23 is provided to an analog-to-digital converter 25 which provides a digital output to the controller 11. The digital output of the A/D converter 25 comprises quantized samples of the analog output of the temperature sensor 23. The output of the A/D converter 25 is indicative of the temperature detected by the temperature sensor 23.

As shown in FIG. 1, optical turn-on energy measuring system hardware 325 (referred hereinafter more simply as "sensor 325") resides within the printer 101 mechanism. While a variety of commercial optical detectors can be employed, a monochromatic optical sensing system is a preferred embodiment. The details of such a particularly preferred system are set forth in U.S. patent application Ser. No. 08/885,486, by Steven H. Walker (assigned to the common assignee of the present invention and incorporated herein by reference). In the main, Walker therein discloses a method and apparatus employing a monochromatic optical sensing system with a single monochromatic illuminating element directed to illuminate a selected portion of the media. The monochromatic optical sensing system also has a photodetecting element directed to receive light reflected from the illuminated selected portions of the media. The photodetecting element generates a signal having an amplitude proportional to the reflectance of the media at the illuminated selected portions. In an illustrated embodiment, a first selected portion of the media has no ink so the photodetecting element generates a "bare-media" signal, while a second selected portion of the media has ink so the photodetecting element generates an "inked-media" signal. A controller compares the difference between the amplitudes of the bare-media signal and the inked-meclia signal with respect to position on the media to determine the position of the ink at the second selected portion of the media. Preferable, the monochromatic illuminating element of the system is a light emitting diode ("LED") that emits a blue light having a peak wavelength selected from the range of 430–470 nanometers. A multifunctional optical sensor could also be employed for the tasks at hand in the present invention. The details of such a particularly multifunctional optical sensor system are set forth in U.S. patent application Ser. No. 09/183,086, by Steven H. Walker (assigned to the common assignee of the present invention and incorporated herein by reference).

Figure 2:
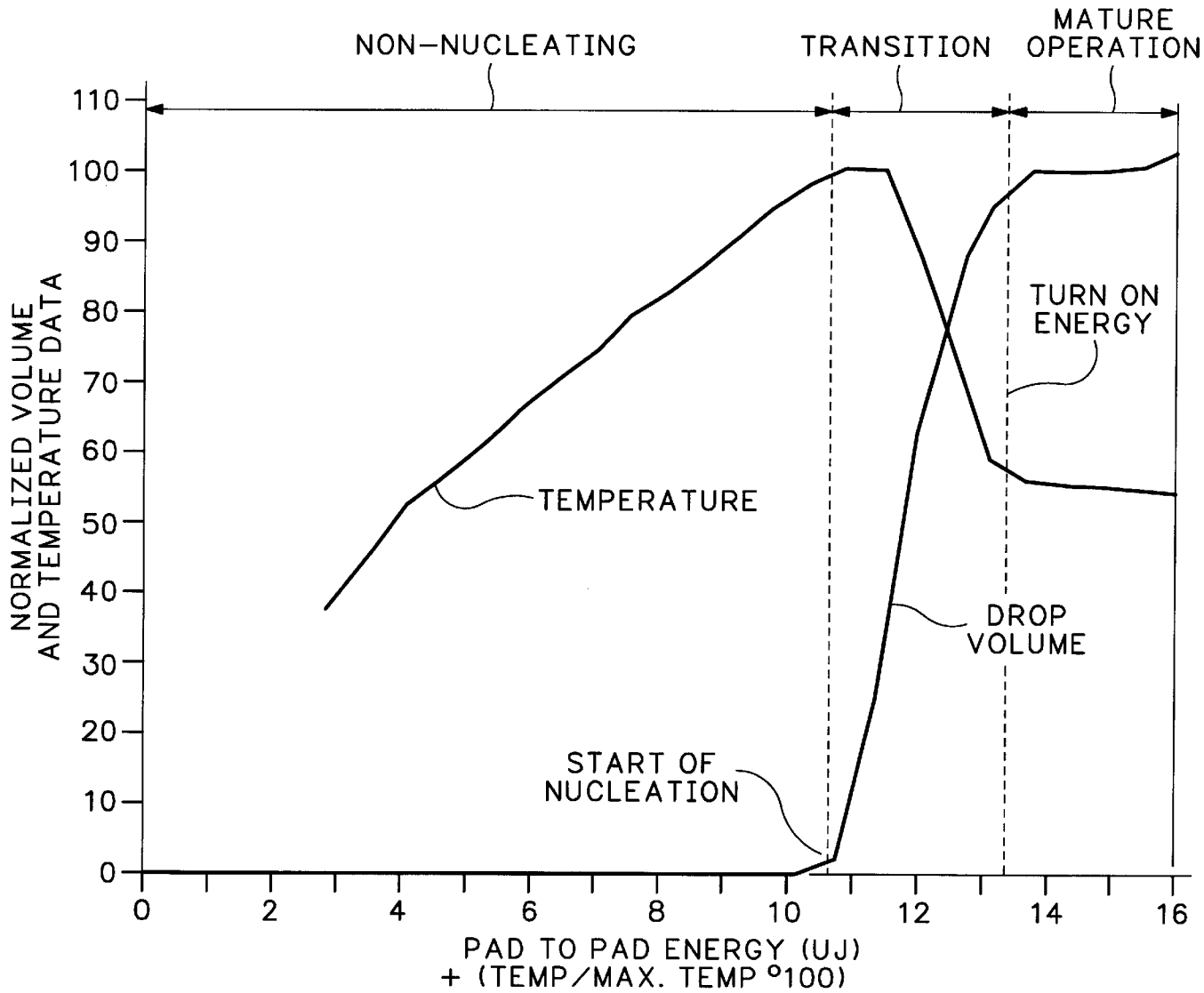
FIG.2 (PRIOR ART)
FIG. 2 (PRIOR ART) is a graph showing printhead temperature and ink drop volume plotted against steady state pulse energy applied to heater resistors of a printhead.
Figures 1, 4:
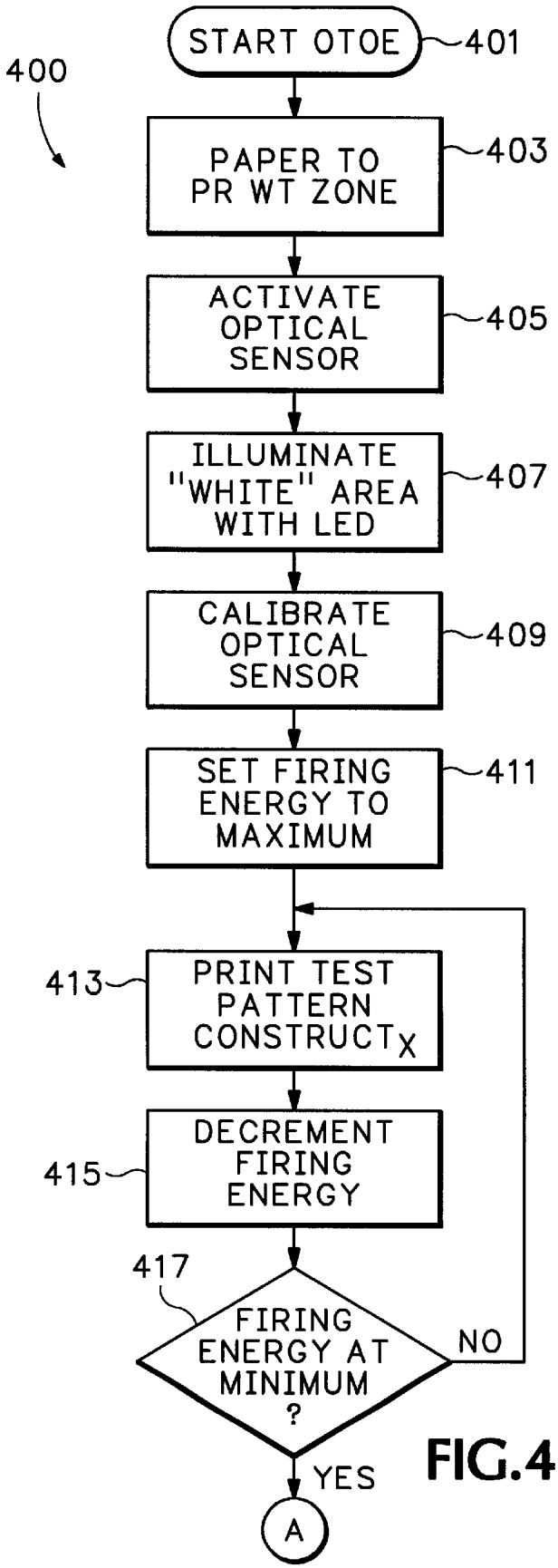
Figures 2, 4:
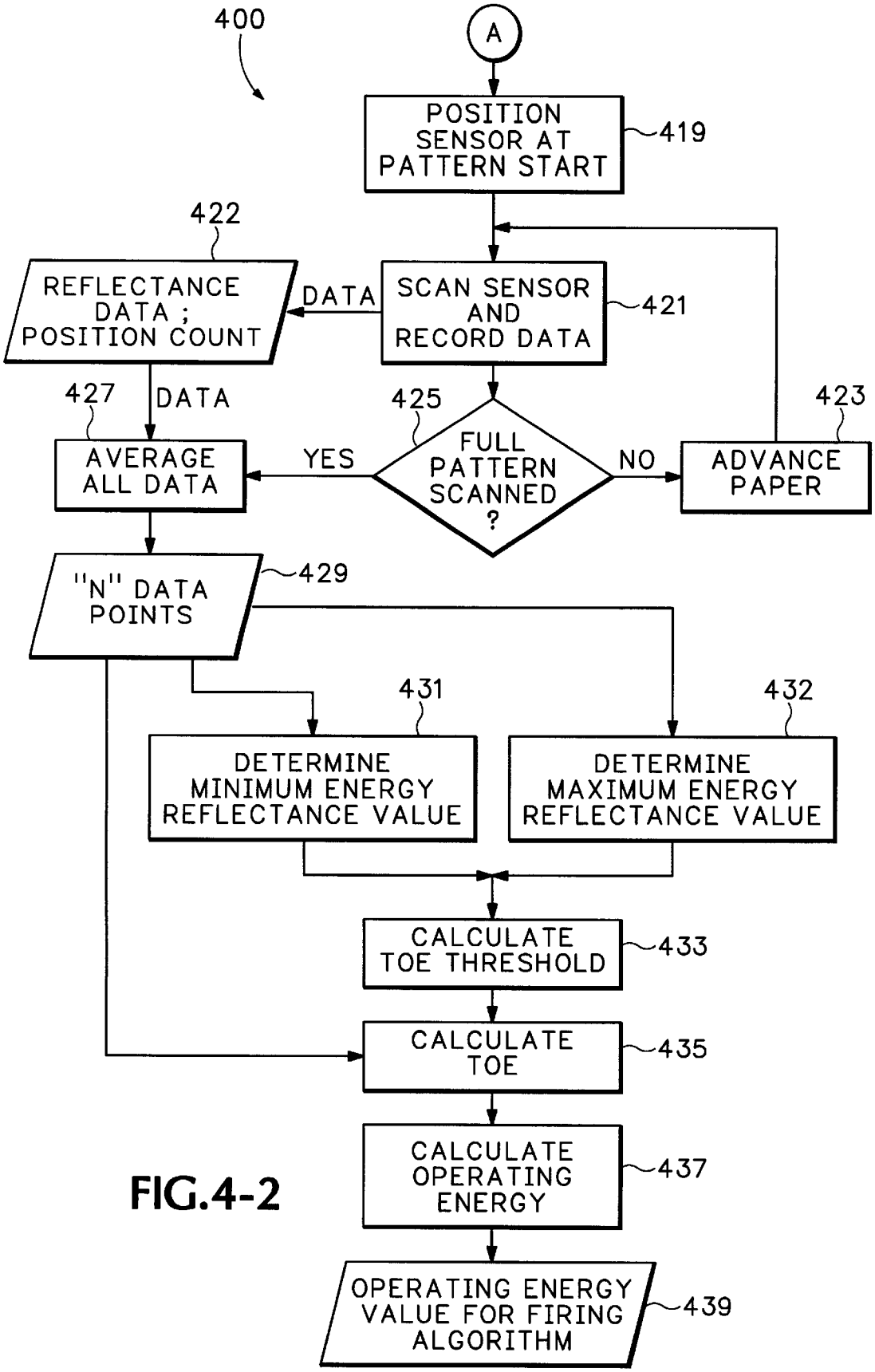

Turning now to FIG. 4-1 and 4-2, and referring also to FIG. 3, an optical turn-on energy, "OTOE," methodology is depicted. The OTOE process 400 is implemented, step 401, whenever a recalibration is desirable—such as when a new pen, or a pen requiring repriming due to lengthy storage, is inserted in the printer's scanning carriage 109 (FIG. 1), or when requested by an end-user call instruction, e.g., when a pen servicing mode is initiated. Known manner maintenance (not shown) is generally performed on such pen or pens to be calibrated in the printer service station, including bringing printheads to a nominal operating temperature and firing ink into a spittoon to clear printhead nozzles. Following servicing, a piece of paper is picked and transported to a print zone, step 403.

Again looking briefly to FIG. 1, while a variety of printhead 19 to hardware arrangements can be implemented, it is assumed for this description that the optical sensor 325 is mounted on the same carriage 109 as the pen set 115. The LED is placed at the forward edge of the printer's carriage 109 roughly aligned with the front-most nozzle of the pen under test. In this fashion, the sensor 325 is positioned to begin scanning immediately across the printed pattern. The sensor 325 is activated, step 405, and moved over an unprinted region of the paper which is illuminated, step 407. The sensor is then calibrated, step 409. The illumination of the LED is adjusted to bring the signal off an unprinted portion of the paper up to the near-saturation level of the A/D converter 25; generally this should be within ten percent of full count tolerance of the specific A/D converter, e.g., a zero-to-five volt range and a 9-bit resolution A/D convert that has a count range of zero (0) to five-twelve (512). The firing energy (in microjoules), driven by VP for the pen to be calibrated is set by the controller 11 at its maximum level for the specific pen design, step 411, at a substantially full count to be indicative of a relative "paper white."

Figure 5:
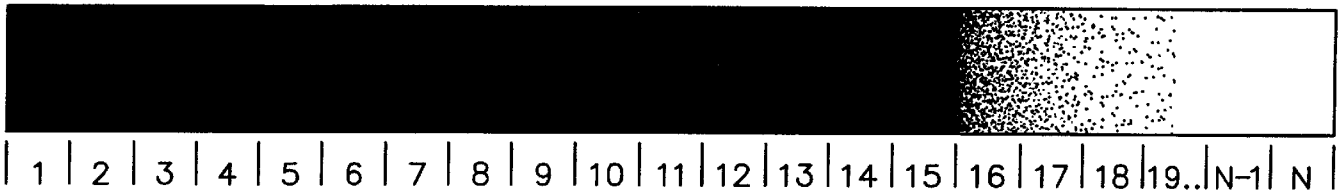
FIG. 5 is an exemplary test pattern used in accordance with the present invention as shown in FIGS. 1,3 and 4-1 through 4-2.

A test pattern, as exemplified by FIG. 5, is printed, step 413. The test pattern 500 can be designed to fit any particular implementation of the present invention; in the simple exemplary embodiment shown, the pattern comprises a construct of a series of contiguous rectangles, numbered |1–|N|, each adjacent rectangle being printed, step 413, at a predetermined decrement of the firing energy, for example, by keeping a constant firing pulse width and incrementally decrementing VP for each rectangle,$_{1-N}$. The rectangles$_{1-N}$ are printed at the full height of the pen swath and approximately a width that is twice that of the sensor 325 field-of-view along the x-axis. The rectangles can be printed with any of the ink colors, composite black, or pigment black. Until the firing energy is decremented to its minimum, step 417, the firing energy is sequentially stepped down, step 415, and the next contiguous test pattern object printed, step 413, until the pattern 500 construct is completed (step 417, YES path). In a preferred embodiment, the final test pattern 500 thus includes a series of N-rectangles, each having a decreasing ink saturation density which is a direct function of the response of the printhead to the decreasing firing energy, positionally tracked using the printer encoder strip 113. Note that a test pattern can also be generated oppositely if the process is started with a minimum firing energy and incremented upwardly to the maximum firing energy as the printhead 19 is scanned in the x-axis.

Once the test pattern 500 is completed, the sensor 325 is positioned at the forward edge of the pattern, i.e., at left-edge rectangle, (assuming left-to-right scanning in a unidirectional or bidirectional printer). Next, step 421, the sensor is scanned across the printed pattern 500. Scanning the sensor 325 includes moving the carriage 109 across the pattern 500 and recording the reflectance at every encoder 113 strip transition along the way—e.g., every 1/600th inch—which provides data independent of scan velocity. The acquired data 422 sampled from the pattern 500 thus consists of scan axis spatial position, in encoder counts, and corresponding reflectance values. Between each scan of the pattern 500, the paper is advanced, generally a distance less than the appropriate field-of-view of the sensor 325, exposing an unscanned portion of the pattern to the sensor 325, step 423. To decrease noise in the sampled data 422 set, typically three to six scans are made, step 425. In the preferred embodiment, A/D conversion of the reflectance readings is triggered at each encoder state transition—e.g., a sampling rate of 600-samples/inch at a carriage speed of approximately six to thirty inches per second, to create the spatially related digital reflectance values data base.

The actual spatial start of the pattern with the data 422 is determined; this is necessary since mechanical mounting tolerances are not sufficient to position the field-of-view of the sensor 325 with respect to the pens 117A–117D (FIG. 1) accurately enough to assure substantially perfect alignment. Alternatively, only a portion of each printed block of the pattern can be used to account for mechanical misalignment (e.g., if a block is 80/600ths wide, the inner 40 points can be used). Unprinted paper is scanned prior to the commencement of the pattern to account for this variability and then the acquired data is aligned to the actual position of first nozzle firing at maximum design specified TOE.

Figure 6:
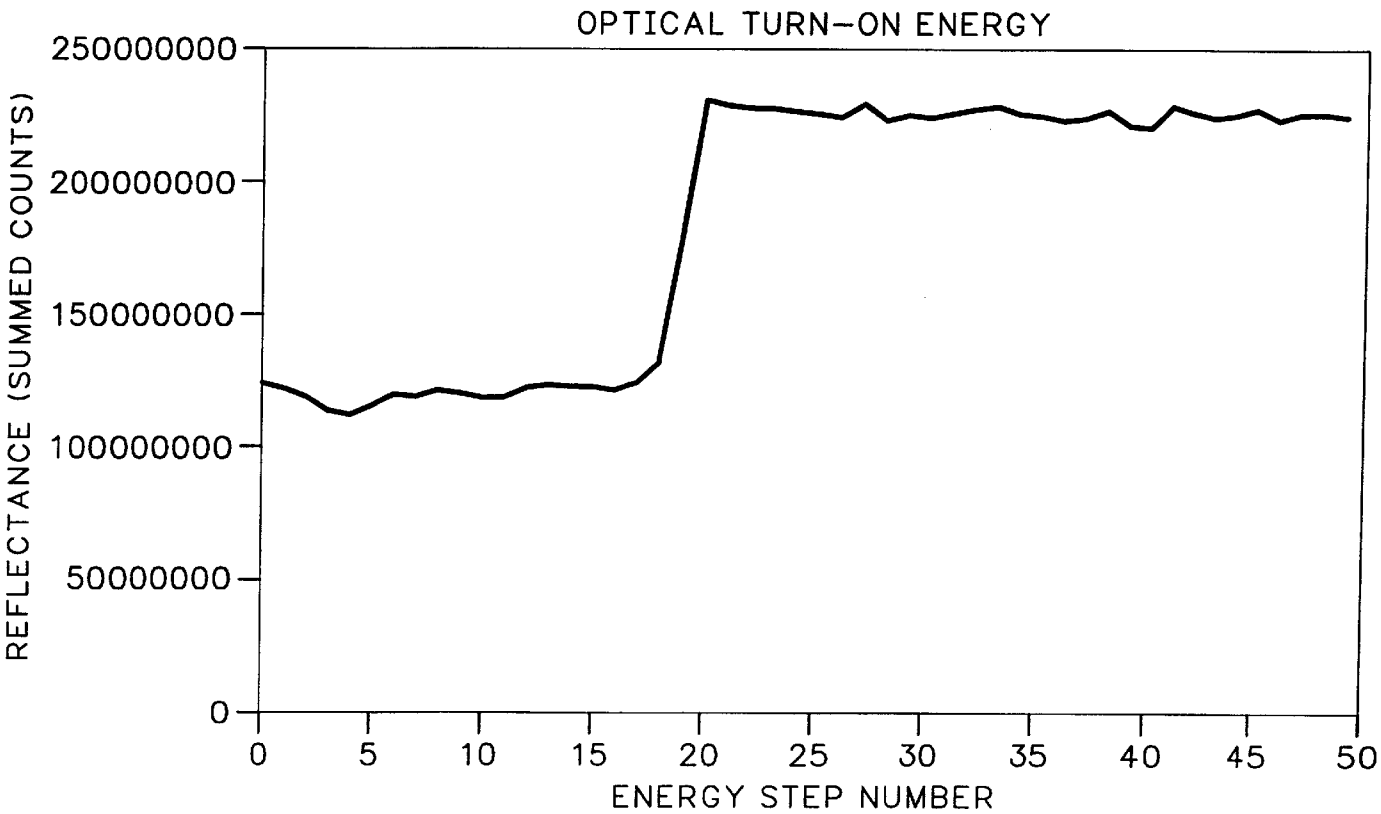
FIG. 6 is a graphical plot of an exemplary data set used in accordance with the present invention as shown in FIGS. 1,3, 4-1 through 4-2, and 5.

The aligned sampled data 422 is averaged. First the data is averaged for each scan, then reduced to one average vector for each rectangle, for example four scan data sets average values of each rectangle$_{1-N}$ provide four values. Then, an average for each rectangle is established, e.g., if there are eighty encoder counts in the x-axis for each rectangle, the data set each square in the present example is 80÷600 wide. The eighty average data points are averaged, creating a second data set 429, for the entire scan data set representing each rectangle$_{1-N}$, where e.g., N=50. In other words, the eighty data points of each rectangle are average to get one value for each energy decremented square which is indicative of an average reflectance for each rectangle$_{1-50}$. An exemplary linear regression curve of the averaged data points, each point representing a rectangle of the pattern 500, is shown in FIG. 6, where each point represents a different firing energy level versus reflectance, where the highest reflectance is the previously calibrated unprinted paper reflectance level.

The second data set 429 is then sorted to determine the acquired minimum energy value (lowest reflectance) 431 and the acquired maximum energy value (highest reflectance from unprinted paper) 432.

The next step 433 is to find the TOE Threshold, where the TOE Threshold is the lowest energy level where greater than approximately ten percent of the nozzles are not firing. The TOE Threshold is determined by starting with the lowest energy value, N=50, and moving backwards through the second data set 429. The running average of slope in reflectance versus energy between each level over "n" contiguous data points—where for example n≧3, or another relevant contiguous sample set of points that eliminates noise from affecting determinations is utilized. In this exemplary plot, the transition from a high-to-low reflectance, viz., the "knee," occurs between energy step number nineteen and energy step number twenty-one. The "knee" in the curve is thus between points twenty-one and twenty where the slope of the curve based on "n" contiguous data points becomes the greatest positive value. This ensures that the global maximum "knee" representing the TOE response has been found. Once the TOE response is identified, the TOE step number is identified as the first energy level at which the slope drops below the TOE Threshold. In exemplary embodiment FIG. 6, the maximum energy value ("EV") 432 is at N=27, lowest energy value 431 is at N=5. Again to be statistically consistent, the test data is normalized; e.g., saturated cyan ink is known experimentally to provide the lowest reflectance value for a subtractive primary color ink for a blue LED sensor 325, approximately 7.5-counts per energy decrement step. TOE Threshold$_{normalized}$ is calculated as:

$$\text{TOE Threshold}_{normalized}=[[(\text{EVmax value})-(\text{EVmin value})]\div[(\text{EVcyan max value})-(\text{EVcyan min value})]]*k, \quad \text{(Equation 3)},$$

where $k_{cyan}=7.5\times100=750$.

The threshold of 7.5 counts/energy step is typical of a change in reflectance when greater than ten percent of nozzles misfire with an energy step of approximately 0.04 microjoule for cyan. Obviously, use of a different LED will require a different normalization factor, k.

With the second data set 429 and having established the TOE Threshold value from Equation 3, TOE can be calculated, step 433, as:

TOE=energy level at step 0−[(TOE Threshold energy level step number)*(energy increment)] (Equation 4).

Actual TOE value is then defined as the energy value where the lowest energy level in which greater than "x" percent of the nozzles are firing, where in this exemplary embodiment x=0.9, or 90%. That is, sorting backwards from the previously determined "knee," the applied TOE value is the first energy level in the energy step data set 429 in which the slope is less that at the TOE Threshold. This is the highest energy value when the slope decreases back under the threshold that still fires all nozzles.

In order to insure proper operation and a higher print quality, once the TOE value is determined, the actual printhead operating energy ("OE") is established, step 437, at a predetermined over-TOE level can be set with a proper firing pulse width and firing voltage, VP, preferably:

OE=1.20×TOE (Equation 5).

OE 439 is then used by the nozzle firing algorithm of the controller 11 for printing operations. In general, the printhead could be operated at about TOE+80% (OE=1.8×TOE) to TOE−5% (OE=0.95×TOE), e.g., for an ink saving draft mode of printing operation since it is below TOE.

Thus, the present invention provides a method and apparatus for optically determining the optimal Operating Energy for the printhead under test such that the automatically implemented Operating Energy provides a desired print quality while avoiding premature failure of the heater resistors. The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the invention be implemented in hardware, software, or firmware. It is intended that the invention be defined by the claims appended hereto and their equivalents.

What is claimed is:

1. A method of determining ink-iet printhead operating energy. comprising the steps of:

printing a test pattern having predetermined objects wherein a series of said objects is printed sequentially using different printhead firing energies having a predetermined pulse energy range;

optically scanning said series of said objects with a scanning apparatus;

using said scanning apparatus, recording a first data set representative of reflectance for each of said objects;

from said first data set. determining a first firing energy value indicative of onset of nozzles ceasing to fire ink; and determining said ink-iet printhead operating energy as a predetermined percentage of said first firing energy value, said step of determining further including, from said first data set, deriving a statistical average reflectance for each of said objects, creating a second data set of "N" data points indicative of the spectrum of reflectance values in said pattern.

2. The method as set forth in claim 1, the step of printing further comprising the step of:

applying to a thermal ink-jet printhead a sequence of pulse bursts of respective pulse energies that span a range from an approximate maximum firing energy value to an approximate minimum firing energy value for said printhead.

3. The method as set forth in claim 2, the step of applying further comprising:

said sequence is a spatially related sequential decreasing pulse energy sequence.

4. The method as set forth in claim 2, the step of applying further comprising:

said sequence is a spatially related sequential increasing pulse energy sequence.

5. The method as set forth in claim 1, further comprising the step of:

prior to the step of optically scanning, calibrating a scanning apparatus used for said step of optically scanning by scanning an unprinted region of print medium used in said method and setting scanning functional parameters to maximum reflectance reading design parameters for the scanning apparatus.

6. The method as set forth in claim 1, said step of optically scanning said series of said objects, further comprising the step of:

performing a series of overlapping scans of each of said objects.

7. The method as set forth in claim 1, said step of determining further comprising the steps of:

selecting a minimum data point from said second data set indicative of a printhead firing energy pulse where no printhead nozzles are firing, selecting a maximum data point from said second data set indicative of a printhead firing energy pulse where all printhead nozzles firing, and selecting a printhead firing data point from said second data between said maximum data point and minimum data point indicative of a printhead firing energy pulse value where onset of a condition of ink drop non-firing occurs.

8. The method as set forth in claim 7, the step of selecting a printhead firing data point from said second data between said maximum data point and minimum data point indicative of a printhead firing energy pulse value where the onset of ink drop non-firing occurs further comprising the steps of:

fitting a curve to said N-data points, and from a data point corresponding to said minimum firing energy value, regressing through said N-data points until a change in slope of said curve occurs where the slope of the curve based on "n" contiguous data points is a maximum positive value of the second data set, where n>2.

9. The method as set forth in claim 8, the step of selecting a printhead firing data point from said second data between said maximum data point and minimum data point indicative of a printhead firing energy pulse value where the onset of ink drop firing non-firing occurs further comprising the steps of:

from said maximum firing energy value, said minimum firing energy value and said printhead firing energy pulse value where ink drop firing ceases, calculating a printhead turn-on energy (TOE) threshold value in accordance with the equation:

$$TOE\,\text{Threshold}_{normalized} = \frac{[(EV\text{max value}) - (EV\text{min value})]}{\left[\begin{array}{c}(EV\text{ reference color max value}) - \\ (EV\text{ reference color min value})\end{array}\right]} * k$$

where "k" is a constant related to a reference primary color ink.

10. The method as set forth in claim 9, the step of selecting a printhead firing data point from said second data between said maximum data point and minimum data point indicative of a pririthead firing energy pulse value where the onset of ink drop non-firing occurs further comprising the steps of:

calculating turn-on energy ("$TOE_1$") for said printhead in accordance with the equation:

$$TOE_1 = \text{energy}_{step\ 0} - [(\text{TOE Threshold energy level step number}) * (\text{energy increment})],$$

where "(energy increment)" is defined as the sequential change in said different printhead firing energies having a predetermined pulse energy range.

11. The method as set forth in claim 9, the step of determining said ink-jet printhead operating energy as a predetermined percentage of said first firing energy value further comprising the steps of:

calculating said operating energy ("OE") for subsequent printhead printing operation in accordance with the equation:

$$OE = TOE_1 * x,$$

where "x" is in the range of approximately 0.95–1.80.

12. A method for operating a thermal ink-jet printer having a printhead having ink drop generators responsive to electrical pulses provided to the printhead, the pulses having a voltage, a pulse width, and a pulse energy defined by voltage, pulse width, and resistance at the printhead and controlled by a drop generator firing algorithm, comprising the steps of:

printing a test pattern in a predetermined axis by applying to the ink drop generators firing pulses having a pulse energy substantially equal to a predetermined reference pulse energy at a predetermined pulse frequency starting with a pulse energy substantially equal to the predetermined reference energy and incrementally changing the pulse energy of the firing pulses such that firing pulses of increasing or decreasing pulse energies are sequentially applied to the drop generators;

scanning said test pattern with a sensing means for determining spatial changes in reflectance of said pattern relative to positions within said pattern where incrementally changing pulse energy occurred and sampling a predetermined number of reflectance data points within said pattern between changes of pulse energy;

determining a predetermined number of reflectance values for said pattern in said predetermined axis as an average reflectance value for said predetermined number of reflectance data points approximately equal to the number of changes of pulse energy;

fitting a curve to said predetermined number of reflectance data points;

determining from said curve a first value indicating a pulse energy maximum indicative of all nozzle firing ink and a second value indicating a pulse energy minimum indicative of no nozzles firing ink;

calculating from said first value and said second value a turn-on energy threshold value;

determining from said turn-on energy threshold value and said curve a turn-on energy value;

determining a final printhead operating energy value which is a predetermined percentage of said turn-on energy value; and providing said drop firing algorithm with said final printhead operating energy value.

13. The method as set forth in claim 12, the step of calculating from said first value and said second value a turn-on energy threshold value further comprising the steps of:

from said maximum firing energy value and said minimum firing energy value, calculating a printhead turn-on energy (TOE) threshold value in accordance with the equation:

$$TOE\,\text{Threshold}_{normalized} = \frac{[(EV\text{max value}) - (EV\text{min value})]}{\left[\begin{array}{c}(EV\text{ reference color max value}) - \\ (EV\text{ reference color min value})\end{array}\right]} * k$$

where "k" is a constant related to a reference primary color ink.

14. The method as set forth in claim 13, the step of determining from said turn-on energy threshold value and said curve a turn-on energy value further comprising the step of:

calculating turn-on energy ("$TOE_1$") for said printhead in accordance with the equation:

$$TOE_1 = \text{maximum energy}_{step\ 0} - [(\text{TOE Threshold energy level step number}) * (\text{energy increment})],$$

where "(energy increment)" is defined as the sequential change in said different printhead firing energies having a predetermined pulse energy range.

15. The method as set forth in claim 14, the step of determining a final printhead operating energy value which is a predetermined percentage of said turn-on energy value further comprising the step of:

calculating said operating energy ("OE") for subsequent printhead printing operation in accordance with the equation:

$$OE = TOE_1 * x,$$

where "x" is in the range of approximately 0.95–1.80.

16. A self-calibrating printhead operating eneray ink-jet hard copy apparatus comprising:

an ink-jet printhead including a plurality of ink firing heaters associated with ink-jet printhead nozzles;

controlled voltage means for providing an energy pulse to said heaters;

connected to said controlled voltage means, controller means for providing a first data set for printing a test pattern with said printhead in a predetermined axis by applying to the heaters energy pulses having a pulse energy substantially equal to a predetermined reference pulse energy at a predetermined pulse frequency starting with a pulse energy substantially equal to the predetermined reference energy and incrementally changing the pulse energy of the firing pulses such that firing pulses of increasing or decreasing pulse energies are sequentially applied to the heaters;

optical scanning means for acquiring data indicative of reflectance values across said pattern;

means for determining from said data a printhead operating energy pulse value that is a predetermined percentage of a turn-on energy threshold defined as a value greater than an energy pulse value where said heaters no longer fire all nozzles, wherein said operating energy pulse value is provided to said controller means for printing operations subsequent thereto, the means for determining further comprising means for deriving from said data a statistical average reflectance for each object of said pattern, creating a second data set of "N" data points indicative of the spectrum of reflectance values in said pattern.

17. The apparatus as set forth in claim 16, the means for determining further comprising the steps of:

means for selecting a minimum data point from said second data set indicative of a printhead firing energy pulse where no printhead nozzles are firing, and means for selecting a maximum data point from said second data set indicative of a printhead firing energy pulse where all printhead nozzles firing.

18. The apparatus as set forth in claim 17, the means for determining further comprising:

means for fitting a curve to said data points and for regressing from a data point corresponding to said minimum firing energy value through said data points until a change in slope of said curve occurs where the slope of the curve based on "n" contiguous data points becomes a value less than a turn-on energy threshold value within a transition from a lower energy value to a higher energy value, where n>2.

19. The apparatus as set forth in claim 18, the means for determining further comprising:

means for calculating a printhead turn-on energy (TOE) threshold value from said maximum firing energy value and said minimum firing energy value in accordance with the equation:

$$TOE\,\text{Threshold}_{normalized} = \frac{[(EV\,\text{max value}) - (EV\,\text{min value})]}{\left[\begin{array}{l}(EV\text{ reference color max value}) - \\ (EV\text{ reference color min value})\end{array}\right]} * k$$

where "k" is a constant related to a reference primary color ink.

20. The apparatus as set forth in claim 19, the means for determining further comprising:

means for calculating turn-on energy ("$TOE_1$") for said printhead in accordance with the equation:

$$TOE_1 = \text{maximum energy level}_{step\ 0} - [(\text{TOE Threshold energy level step number}) * (\text{energy increment})],$$

where "(energy increment)" is defined as the sequential change in said different printhead firing energies having a predetermined pulse energy range.

21. The apparatus as set forth in claim 20, the means for determining further comprising:

means for calculating said operating energy ("OE") for subsequent printhead printing operation in accordance with the equation:

$$OE = TOE_1 * x,$$

where "x" is in the range of approximately 0.95–1.80.

22. A computer memory apparatus for determining operating energy for an ink-jet printhead comprising:

means for printing a test pattern having predetermined objects wherein a series of said objects is printed using different printhead firing energy ranging from a maximum firing energy value to a minimum firing energy value;

means for receiving data acquired by optically scanning said series of said objects and recording a first data set having a value representative of reflectance for each of said objects;

means for determining from said first data set a first firing energy value indicative of onset of non-firing of ink-iet nozzles of ink; and means for determining said ink-jet printhead operating energy as a predetermined percentage of said first firing energy value the means for determining further comprising means for deriving from said data a statistical average reflectance for each object of said pattern, creating a second data set of "N" data points indicative of the spectrum of reflectance values in said pattern.

23. The apparatus as set forth in claim 22, the means for determining further comprising the step of:

means for selecting a minimum data point from said second data set indicative of a printhead firing energy pulse where no printhead nozzles are firing, and means for selecting a maximum data point from said second data set indicative of a printhead firing energy pulse where all printhead nozzles firing.

24. The apparatus as set forth in claim 23, the means for determining further comprising:

means for fitting a curve to said data points and for regressing from a data point corresponding to said minimum firing energy value through said data points until a change in slope of said curve occurs where the slope of the curve based on "n" contiguous data points becomes a greatest positive value of the data set, where n>2.

25. The apparatus as set forth in claim 24, the means for determining further comprising:

means for calculating a printhead turn-on energy (TOE) threshold value from said maximum firing energy value and said minimum firing energy value in accordance with the equation:

$$TOE\,\text{Threshold}_{normalized} = \frac{[(EV\,\text{max value}) - (EV\,\text{min value})]}{\left[\begin{array}{l}(EV\text{ reference color max value}) - \\ (EV\text{ reference color min value})\end{array}\right]} * k$$

where "k" is a constant related to a reference primary color ink.

26. The apparatus as set forth in claim 25, the means for determining further comprising:

means for calculating turn-on energy ("$TOE_1$") for said printhead in accordance with the equation:

$$TOE_1 = \text{energy maximum}_{step\ 0} - [(\text{TOE Threshold energy level step number}) * (\text{energy increment})],$$

where "(energy increment)" is defined as the sequential change in said different printhead firing energies having a predetermined pulse energy range.

27. The apparatus as set forth in claim 26, the means for determining further comprising:

means for calculating said operating energy ("OE") for subsequent printhead printing operation in accordance with the equation:

$$OE = TOE_1 * x,$$

where "x" is in the range of approximately 0.95–1.80.

* * * * *